United States Patent [19]

Arnaud

[11] 4,351,280

[45] Sep. 28, 1982

[54] PROCESSES AND DEVICES FOR AUTOMATIC CONTROL TO IGNITION ADVANCE

[75] Inventor: Gaston Arnaud, Paris, France

[73] Assignee: Societe Industrielle de Brevets et d'Etudes SIBE, Neuilly-sur-Seine, France

[21] Appl. No.: 138,432

[22] Filed: Apr. 8, 1980

[30] Foreign Application Priority Data

Apr. 13, 1979 [FR] France ..... 79 09528

[51] Int. Cl.[3] ..... F02P 5/10

[52] U.S. Cl. ..... 123/415; 123/407; 123/418

[58] Field of Search ..... 123/406, 407, 409, 415, 123/418, 146.5 R, 488

[56] References Cited

U.S. PATENT DOCUMENTS

| | | | |
|---|---|---|---|
| 2,538,377 | 1/1951 | Ostling | 123/407 |
| 2,659,353 | 11/1953 | Mallory | 123/407 |
| 2,825,320 | 3/1958 | Brueder | 123/407 |
| 3,062,929 | 11/1962 | Larges et al. | 123/407 |
| 3,202,146 | 8/1965 | Short et al. | 123/415 |
| 4,140,092 | 2/1979 | Lanning et al. | 123/407 |
| 4,142,489 | 3/1979 | Menard | 123/418 |
| 4,142,494 | 3/1979 | Negri et al. | 123/407 |
| 4,242,996 | 1/1981 | Urbansky | 123/407 |

*Primary Examiner*—Charles J. Myhre
*Assistant Examiner*—Andrew M. Dolinar
*Attorney, Agent, or Firm*—John T. Synnestvedt; Albert L. Free

[57] ABSTRACT

The degree of ignition advance of a supercharged spark ignition internal combustion engine is automatically controlled. The controlling device comprises a first member for increasing advance when the speed of the engine increases. It also comprises a second control member (6) connected to a point of the induction passage (1) which passes from upstream to downstream of the operator operated throttle member (2) upon opening thereof and to a point (17) which is permanently upstream of the throttle member.

1 Claim, 5 Drawing Figures

PROCESSES AND DEVICES FOR AUTOMATIC CONTROL TO IGNITION ADVANCE

BACKGROUND AND SUMMARY OF THE INVENTION

The present invention relates to processes and devices for adjusting the ignition advance for internal combustion engines supercharged by a turbine-compressor unit.

Conventionally, the ignition advance for a spark ignition engine is controlled by a combination of the action of a centrifugally controlled advance system, which gives an advance as an increasing function of engine speed, and a system controlled by the depression which prevails in the intake pipe of the engine at a point situated slightly upstream of the operator controlled throttle member when the member is in its minimum open position, corresponding to idle running of the engine. As soon as the engine is charged by opening the butterfly valve, the depression pick-up is subjected to the high depression due to the suction of the engine and the system, generally formed by a pneumatic motor, gives a substantial advance to the engine. An advance curve well adapted to the different operating conditions of the engine is then obtained, if the engine is not supercharged.

Attempts to use such a device with an engine supercharged by a turbo-compressor whose turbine receives the exhaust gases of the engine have met with difficulties in obtaining satisfactory matching for all operating conditions of the engine. The difficulties are tied to the fact that the turbo-compressor has no action when the engine is idling or under very low load, so that the engine then receives air under atmospheric pressure, and provides an increasing supercharging pressure from partial load only. Due to supercharging, the ignition advance on full load of the engine must be smaller than that for a non supercharged engine.

Up to now, the approach selected to have satisfactory advance at full load, consists in shifting as a whole the ignition advance curve in the direction of advance decrease. The drawback of that approach is that the amount of advance for partial charges of the engine is too small.

It is an object of the invention to provide an ignition advance curve which is satisfactory under all operating conditions of an engine supercharged by a turbo-compressor.

According to the invention, there is provided a process for control of the ignition advance of a spark ignition engine supercharged by a turbo-compressor, wherein the degree of advance is automatically modified as an increasing function of the speed and as a function of a control pressure which is elaborated from pressures taken from a point of the intake pipe which passes from upstream to downstream of the operator operated throttle member upon opening of said member from its minimum opening position and from a point situated permanently upstream of said throttle member, so that in operation under constant load, the degree of ignition advance increases from idle running in a first speed range, then diminishes in a second range up to maximum speed of the engine.

According to another aspect of the invention, there is provided a device for automatic control of the ignition advance of a spark ignition engine supercharged by a turbo-compressor, comprising a first member for increasing the degree of advance as an increasing function of engine speed and a second control member connected to a point which passes from upstream to downstream of the operator operated throttle member upon opening of said throttle member from its minimum opening position and to a point which is permanently situated upstream of said throttle member so as to cause, for a constant load of the engine, a progressive increase of the degree of advance from idle running, then a decrease up to maximum speed.

The device may be purely mechanical: the second control member may then comprise a movable wall whose movements control the degree of advance, limiting a work chamber, the force exerted on said wall by vacuum prevailing in said chamber biases the movable wall in the direction corresponding to an increase of the degree of advance against the action of a first spring, whereas the force exerted on said wall by overatmospheric pressure in said work chamber biases the wall in a direction corresponding to a decrease of the degree of advance, against the action of a second spring.

The device may also be implemented by using electronic means; this solution is of particular advantage if the engine is fitted with a digital or analog computer which also fulfils other functions, such as metering the amount of fuel admitted to the engine.

The invention will be better understood from the following description of embodiments of the invention, given by way of examples. The description refers to the accompanying drawings.

SHORT DESCRIPTION OF THE DRAWINGS

Figure 3:
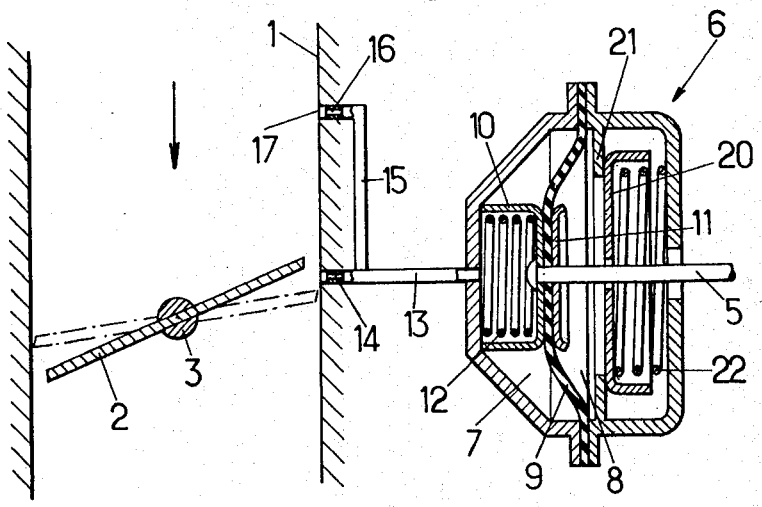
FIG. 3 is a simplified diagram in cross-section, showing the pressure-responsive member of an advance controlling device according to a first embodiment of the invention, the moving parts being in the positions which they assume when the engine is under partial load, before supercharging occurs, which corresponds to a maximum degree of advance given by the second control member.
Figure 4:
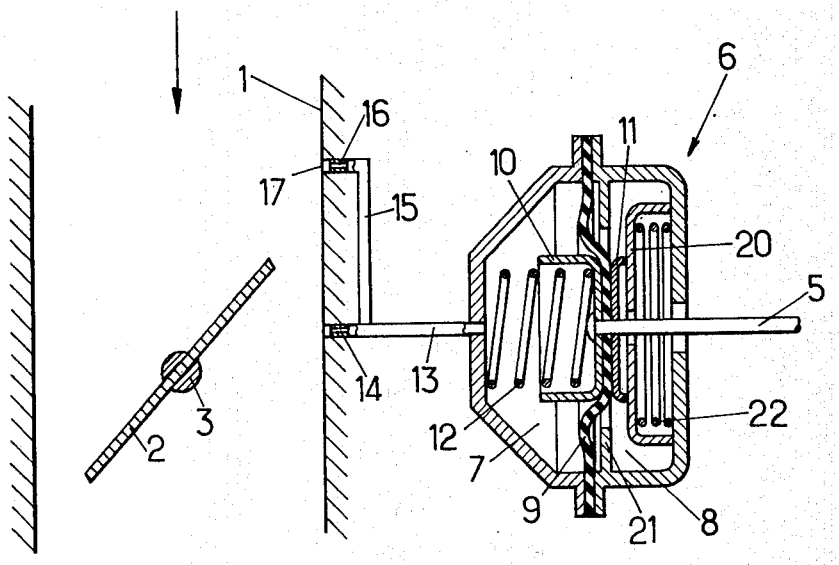

FIG. 4, similar to FIG. 3, shows the parts in a position corresponding to a reduction of advance by the second control member, under operating conditions where the engine is supercharged.

Figure 5:
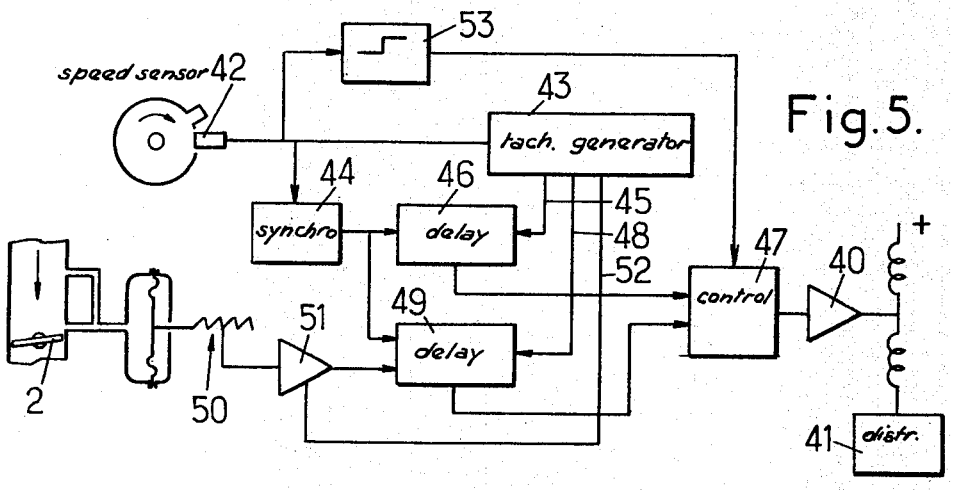

FIG. 5 is a simplified diagram of an electronic automatic adjustment device forming a second embodiment of the invention.

DETAILED DESCRIPTION OF PARTICULAR EMBODIMENTS

Before describing the invention, a few general notions concerning the ignition advance of spark ignition internal combustion engines will be recalled.

Figure 1:
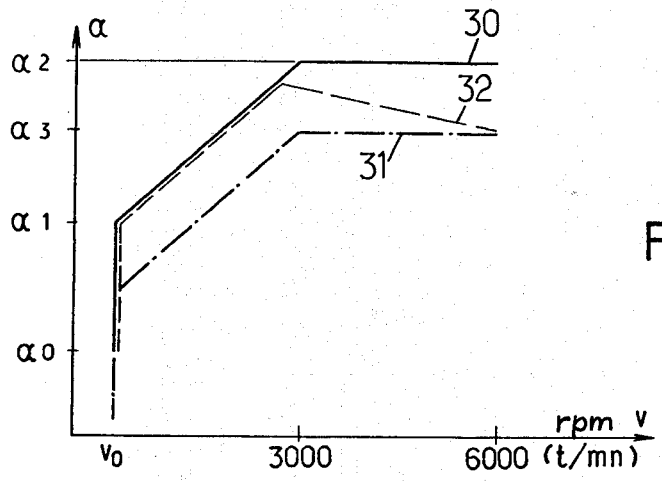
FIG. 1 is a diagram showing typical ignition advance curves for an engine as a function of engine speed at constant load charge.

In FIG. 1, curve 30 shown by a continuous line, gives the general outline of the variation of the ignition advance angle $\alpha$ as a function of speed v, from idling speed $v_o$. As soon as the engine is loaded by opening the throttle member controlled by the driver, the degree of advance increases from an initial value $\alpha_0$ to a value $\alpha_r$. At constant load, when the speed increases, the advance must increase to a value $\alpha_2$ which is reached when the speed of the engine is about half its maximum rated speed. The advance then remains almost constant up to maximum speed.

Figure 2:
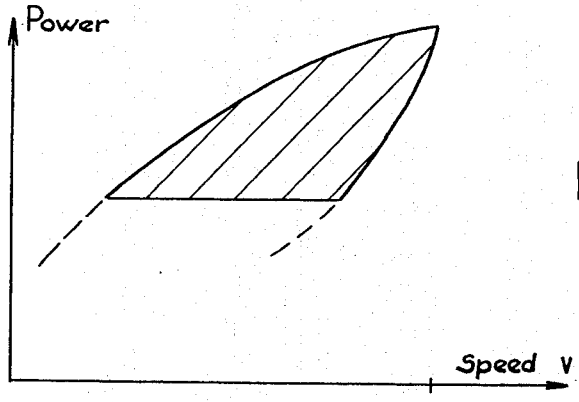
FIG. 2 is a diagram of the power P vs speed v showing the zones corresponding to effective supercharging of an engine.

When the engine is provided with a supercharging turbo-compressor, the turbo-compressor only comes into action to increase the intake pressure of the engine in a range which is typically that shown by hatching in FIG. 2. The angle $\alpha_3$ of ignition advance required for satisfactory operation of such an engine at full power is less than $\alpha_2$. The solution generally used up to now to obtain this result consisted in shifting as a whole the ignition advance curve so that it takes up the position indicated at 31 in FIG. 1: then the degree of ignition advance is too small for the whole range of partial loads. According to the invention, a curve whose general outline is indicated at 32 may be obtained.

In the embodiment shown schematically in FIGS. 3 and 4, that object is fulfilled using mechanical means. Referring to FIGS. 3 and 4, there is shown an intake pipe 1 supplying an engine (not shown) and in which flows a mixture of fuel and of air coming from the compressor of a turbo-compressor (not shown). Intake pipe 1 is provided with a throttle member 2, formed by a butterfly valve pivoting about a pin 3 and controlled by the driver through a linkage (not shown). Up to a predetermined power threshold (FIG. 2), the engine operates practically as if it were under natural suction. Beyond the threshold supercharging becomes effective. To limit the degree of supercharging, a waste gate is generally placed in the exhaust pipe of the engine and limits the pressure which prevails therein and the flow of exhaust gases passing through the turbine of the turbo-compressor.

The engine is provided with an ignition advance device comprising a cascade arrangement of a first member increasing the advance of a direct function of the speed, generally of the centrifugal type, and a second pneumatic member. The centrifugal member, which say be conventional, is not shown.

The pneumatic member 6 comprises a casing made from several assembled parts locating a movable assembly carrying a rod 5 controlling the degree of ignition advance. Member 6 is mounted so that a movement of rod 5 towards the left tends to increase the degree of ignition advance.

A diaphragm 9, whose outer portion is fixed to the casing separates a work chamber 7 connected to intake pipe 1 from a chamber 8 subjected to the atmospheric pressure. The central part of membrane 9 is clamped between cups 10 and 11 connected to rod 5. A spring 12 in chamber 7 forces the movable assembly of member 6 towards the right of the Figure. The action of spring 12 is opposed to the pressure forces exerted on diaphragm 9 when a depression prevails in work chamber 7.

The arrangement described up to now is conventional. But work chamber 7 is connected to intake pipe 1 not only by a line 13 having a calibrated orifice 14 opening into pipe 1 through an orifice which passes from upstream to downstream of the edge of butterfly valve 2 when this latter is partly opened from its minimum opening position (shown in dash-dot lines in FIG. 3), but also by means of a line 15 having a calibrated orifice 16 and opening into pipe 1 through an orifice 17 which remains permanently upstream of the edg eof butterfly vavle 2.

In addition, the support against which spring 12 tends to apply the mobile assembly is not stationary. It is formed by a bearing part 20 which a spring 22, exerting a higher force than spring 12, tends to apply against a fixed stop 21 provided on the casing of member 6. Part 20 has a central hole therethrough for the passage of rod 5.

The pneumatic member operates as follows:

When the engine is idling, with butterfly valve 2 in the position shown in dash-dot lines in FIG. 3, work chamber 7 is substantially at atmospheric pressure. Spring 12 then maintains the movable assembly against bearing part 20, itself maintained in contact with stop 21 by spring 22.

If the engine is lightly loaded moving the butterfly valve 2 into the position shown with a continuous line in FIG. 3, the opening of line 13 passes upstream of the edge of butterfly valve 2. A high level of depression is transmitted to chamber 7 and causes the movable assembly to move towards the left against the force of spring 12, until cup 10 abuts the casing of member 6. That portion corresponds to the maximum advance provided by member 6.

Upon continued loading of the engine, the turbo-compressor supplies a supercharging, i.e. overatmospheric pressure. Orifice 17 is then subjected to a pressure which increases with the power developed by the engine. A moment will come when the pressure in work chamber 7, intermediate between those taken by the calibrated orifices 14 and 16, is sufficient for forcing the movable assembly to the right of the figure. The assembly then abuts part 20, then forces part 20 back, against the force of spring 22, while progressively reducing the advance until the advance angle due to the depression has the value corresponding to full load of the engine, determined by the abutment of part 20 against the casing of member 6 (FIG. 4).

Instead of being purely mechanical, the control device may include electronic components and particularly have the construction shown schematically in FIG. 5.

The device shown in FIG. 5 comprises an ignition circuit formed by a power amplifier 40 connected to a distributor 41 through an inductance circuit which is of the type conventional in electronic ignition circuits. The advance control may be regarded as having a tachometric channel and a depression controlled channel which will be described successively and controls the time delay between the occurence of the time reference pulses delivered by a sensor 42 and the actual generation of sparks at the ignition plugs. Sensor 42, which may be controlled by a magnet driven by the engine, delivers pulses through a shaping circuit (not shown) to a timing circuit 44. In response, timing circuit 44 delivers pulses to programmable time delays generators 46 and 49 providing variable time delays.

The tachometric channel comprises the time delay generators and a programmable tachometric generator 43 with three outputs 45, 48 and 52. Generator 43 receives the signal pulse at variable frequency from sensor 42 and is designed to deliver a signal whose value is an increasing function of speed:

on output 45 connected to the control input of time delay generator 46 until the speed attains a predetermined value, on outputs 48 and 52 respectively connected to the control input of programmable time delay generator 49 and to the gain control input of an amplifier 51.

The pressure responsive channel comprises a pressure sensor 50 associated with a pneumatic member similar to member 6 and delivering an electric DC signal to amplifier 51 whose gain is controlled by output 52. The output of 51 cooperates with output 48 in determining the time delay impressed by generator 49 to the pulses from 44.

The pulses delayed in time delay circuits 46 or 49 (depending upon which it is energized) are applied to a main control circuit 47 which triggers the power amplifier 40.

Last, the system comprises an idling detector 53, typically consisting of a threshold detector whose input is connected to the shaping circuit associated with sensor 42. Detector 53 supplies a signal when the engine is idling. That signal inhibits the inputs of circuit 47 from generators 46 and 49 and impose a fixed ignition delay.

The system operates as follows:

During idling at speed $v_o$ (FIG. 1) circuit 53 imposes a predetermined angle of ignition advance $\alpha_o$.

As soon as the engine runs under partial load the branch formed by timing circuit 44 and time delay 46 controls the degree of advance and increases it when the speed increases.

Finally, from a predetermined speed (abrupt bend on FIG. 1), the tachometric generator 43 energizes generator 49 and variable gain amplifier 51. The latter modifies the law of variation of the advance as a function of the pressure and imposes, from a predetermined speed, a progressive reduction of the advance.

I claim:

1. In a spark ignition engine having an intake pipe an operator operable throttle member in said intake pipe and a turbine-compressor unit whose compressor is located in said intake pipe upstream of said throttle member, a device for automatically adjusting the ignition advance, comprising:

tachometric generator means operatively connected to said engine and constructed to supply an electric synchronization signal for each ignition of the engine and a control signal whose value is an increasing function of the engine speed, pressure sensing means, having a chamber connected to a point of said intake pipe which passes from upstream to downstream of said throttle member upon opening of the latter from its minimum opening position and to a point of said intake pipe which is continuously located upstream of said throttle member and arranged to deliver an electric signal representative of the pressure in said chamber, a variable gain amplifier connected to receive said pressure responsive signal and to deliver an output signal amplified in a ratio determined by the value of the control signal from said tachometric generator means, and programmable delay means connected to receive a delay control signal from said amplifier and said synchronisation signal and to deliver an output signal causing engine ignition.

* * * * *